US005562238A

United States Patent [19]

White

[11] Patent Number: 5,562,238

[45] Date of Patent: Oct. 8, 1996

[54] DEVICE FOR SUPPORTING ITEMS FOR USE BY A LAW ENFORCEMENT OFFICER

[76] Inventor: Roger A. White, 111 Ashlawn La., Monroe, La. 71203

[21] Appl. No.: 517,218

[22] Filed: Aug. 21, 1995

[51] Int. Cl.[6] ..... B65D 37/00

[52] U.S. Cl. ..... 224/237; 224/236; 224/240; 224/914; 383/85; 383/40; 383/41

[58] Field of Search ..... 224/237, 236, 224/235, 216, 224, 226, 228, 914, 240, 931, 195, 239; 206/317, 573, 580, 446, 38, 234; 220/524; 150/112, 117, 147; 383/85, 40, 41

[56] References Cited

U.S. PATENT DOCUMENTS

| | | | |
|---|---|---|---|
| 1,648,565 | 11/1927 | Primley | 224/237 |
| 1,670,945 | 5/1928 | Ward | 224/240 |
| 3,552,610 | 11/1971 | Coleman | 224/240 |
| 3,769,733 | 11/1973 | Nelson | 224/239 |
| 4,119,249 | 10/1978 | Hanson | 224/236 |

*Primary Examiner*—David J. Walczak

[57] ABSTRACT

The present invention relates to a device for supporting items for use by a law enforcement officer. The device comprises a central container formed of a flexible material in a box-like configuration. The container has large rectangular parallel front and rear walls with small rectangular parallel side walls therebetween. In addition, the container also has a rectangular bottom wall with peripheral edges coupled to the lower edges of the front, rear and side walls. The container also has a vertically disposed divider wall coupling the front, rear and bottom walls parallel with the side walls forming two regions. A pair of laterally disposed upper flaps as an upward extension from the upper extent of the rear wall are adapted to cover the upper edges of the front, rear and side walls for selectively opening and closing access to the regions of the container. First fasteners are located on the interior faces of the upper flaps and on the exterior face of the front wall for releasably securing the upper flaps in a locked orientation with the access to the interior regions precluded.

1 Claim, 3 Drawing Sheets

DEVICE FOR SUPPORTING ITEMS FOR USE BY A LAW ENFORCEMENT OFFICER

BACKGROUND OF THE INVENTION

1. Field of the Invention

The present invention relates to a device for supporting items for use by a law enforcement officer and, more particularly, pertains to consolidating and supporting ammunition magazines, handcuffs, a flashlight and an expandable baton to render them readily accessible at a common, convenient point.

2. Description of the Prior Art

The use of devices for supporting miscellaneous objects of various designs and configurations is known in the prior art. More specifically, devices for supporting miscellaneous objects of various designs and configurations heretofore devised and utilized for the purpose of supporting items of use by a wearer through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,826,414 to Valadez a handcuff holster with means provided for securing the holster to a belt.

U.S. Pat. No. 4,852,784 to Burton, Jr. discloses a handcuff holder that attaches to a handgun holster for the purpose of keeping the handcuffs and handgun together.

U.S. Pat. No. Des. 280,357 to Scheller discloses an ornamental design for a belt pouch.

U.S. Pat. No. Des. 293,628 to Teachey discloses an ornamental design for a belt mounted flashlight holder.

Lastly, U.S. Pat. No. Des. 309,374 to Lightfoot discloses an ornamental design for a gun and handcuff holder In this respect, the device for supporting items for use by a law enforcement officer according to the present invention substantially departs from the conventional concepts and designs of the prior art, and in so doing provides an apparatus primarily developed for the purpose of consolidating and supporting ammunition magazines, handcuffs, a flashlight and an expandable baton to render them readily accessible at a common, convenient point.

Therefore, it can be appreciated that there exists a continuing need for a new and improved device for supporting items for use by a law enforcement officer which can be used for consolidating and supporting ammunition magazines, handcuffs, a flashlight and an expandable baton to render them readily accessible at a common, convenient point. In this regard, the present invention substantially fulfills this need.

SUMMARY OF THE INVENTION

In view of the foregoing disadvantages inherent in the known types of devices for supporting miscellaneous objects of various designs and configurations now present in the prior art, the present invention provides an improved device for supporting items for use by a law enforcement officer. As such, the general purpose of the present invention, which will be described subsequently in greater detail, is to provide a new and improved device for supporting items for use by a law enforcement officer and method which has all the advantages of the prior art and none of the disadvantages.

To attain this, the present invention essentially comprises a new and improved device for supporting items for use by a law enforcement officer comprising, in combination, a central container formed of a flexible material in a box-like configuration, the container having large rectangular parallel front and rear walls with small rectangular parallel side walls therebetween, the container also having a rectangular bottom wall with peripheral edges coupled to the lower edges of the front, rear and side walls, the container also having a vertically disposed divider wall coupling the front, rear and bottom walls parallel with the side walls forming two regions for the receipt of ammunition magazines; a pair of laterally disposed upper flaps as an upward extension from the upper extent of the rear wall adapted to cover the upper edges of the front, rear and side walls for selectively opening and closing access to the regions of the container, first fasteners on the interior faces of the upper flaps and on the exterior face of the front wall for releasably securing the upper flaps in a locked orientation with the access to the interior regions precluded; a supplemental flap having an upper edge secured to the exterior surface of the front wall at a location beneath the first fastener, the lower flap extending downwardly to a location adjacent to the lower extent of the front wall, co-acting second fasteners secured to the interior surface of the lower flap adjacent to its lower edge and the exterior surface of the front wall adjacent to its lower extent, the second flap adapted to form an opening for the receipt and support of handcuffs and also adapted to be unsnapped for the release of the handcuffs therefrom; a pair of rectangular side supports including a first support and a second support, each of the side supports having upper and lower edges and parallel side edges therebetween with the side edges of each side support secured to an associated side edge of a side wall to form a loop for the receipt and support of a cylindrical object, a flashlight in one loop and an extensible baton on the other loop; and a pair of vertically disposed straps laterally attached to the exterior surface of the rear face for being received and supported by a belt of a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for supporting items for use by a law enforcement officer which has all the advantages of the prior art devices for supporting miscellaneous objects of various designs and configurations and none of the disadvantages.

It is another object of the present invention to provide a new and improved device for supporting items for use by a law enforcement officer which may be easily and efficiently manufactured and marketed.

It is a further object of the present invention to provide a new and improved device for supporting items for use by a law enforcement officer which is of a durable and reliable construction.

An even further object of the present invention is to provide a new and improved device for supporting items for use by a law enforcement officer which is susceptible of a low cost of manufacture with regard to both materials and labor, and which accordingly is then susceptible of low prices of sale to the consuming public, thereby making such devices for supporting miscellaneous objects of various designs and configurations economically available to the buying public.

Still yet another object of the present invention is to provide a new and improved device for supporting items for use by a law enforcement officer which provides in the apparatuses and methods of the prior art some of the advantages thereof, while simultaneously overcoming some of the disadvantages normally associated therewith.

Even still another object of the present invention is to consolidate and support ammunition magazines, handcuffs, a flashlight and an expandable baton to render them readily accessible at a common, convenient point.

Lastly, it is an object of the present invention to provide a device for supporting items for use by a law enforcement officer. The device comprises a central container formed of a flexible material in a box-like configuration. The container has large rectangular parallel front and rear walls with small rectangular parallel side walls therebetween. In addition, the container also has a rectangular bottom wall with peripheral edges coupled to the lower edges of the front, rear and side walls. The container also has a vertically disposed divider wall coupling the front, rear and bottom walls parallel with the side walls forming two regions. A pair of laterally disposed upper flaps as an upward extension from the upper extent of the rear wall are adapted to cover the upper edges of the front, rear and side walls for selectively opening and closing access to the regions of the container. First fasteners are located on the interior faces of the upper flaps and on the exterior face of the front wall for releasably securing the upper flaps in a locked orientation with the access to the interior regions precluded.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
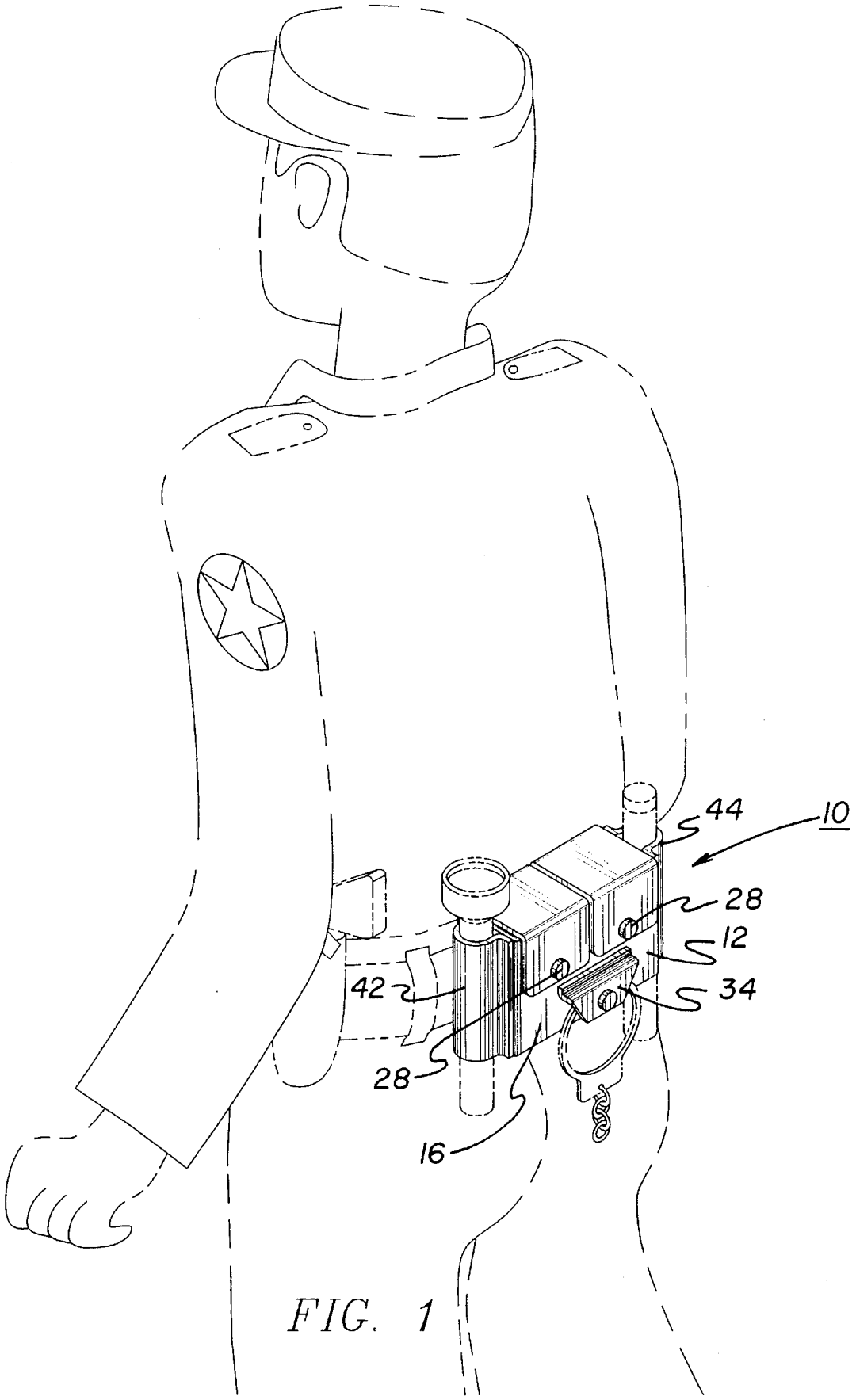
FIG. 1 is a perspective illustration of the preferred embodiment of the new and improved device for supporting items for use by a law enforcement officer constructed in accordance with the principles of the present invention.
Figure 2:
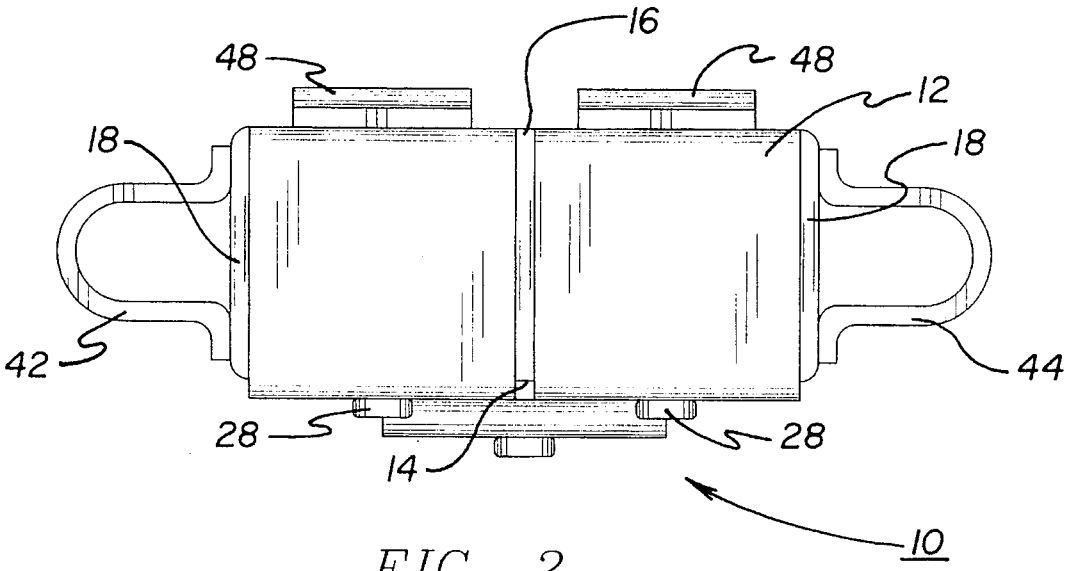
FIG. 2 is a top view of the device shown in FIG. 1.
Figure 3:
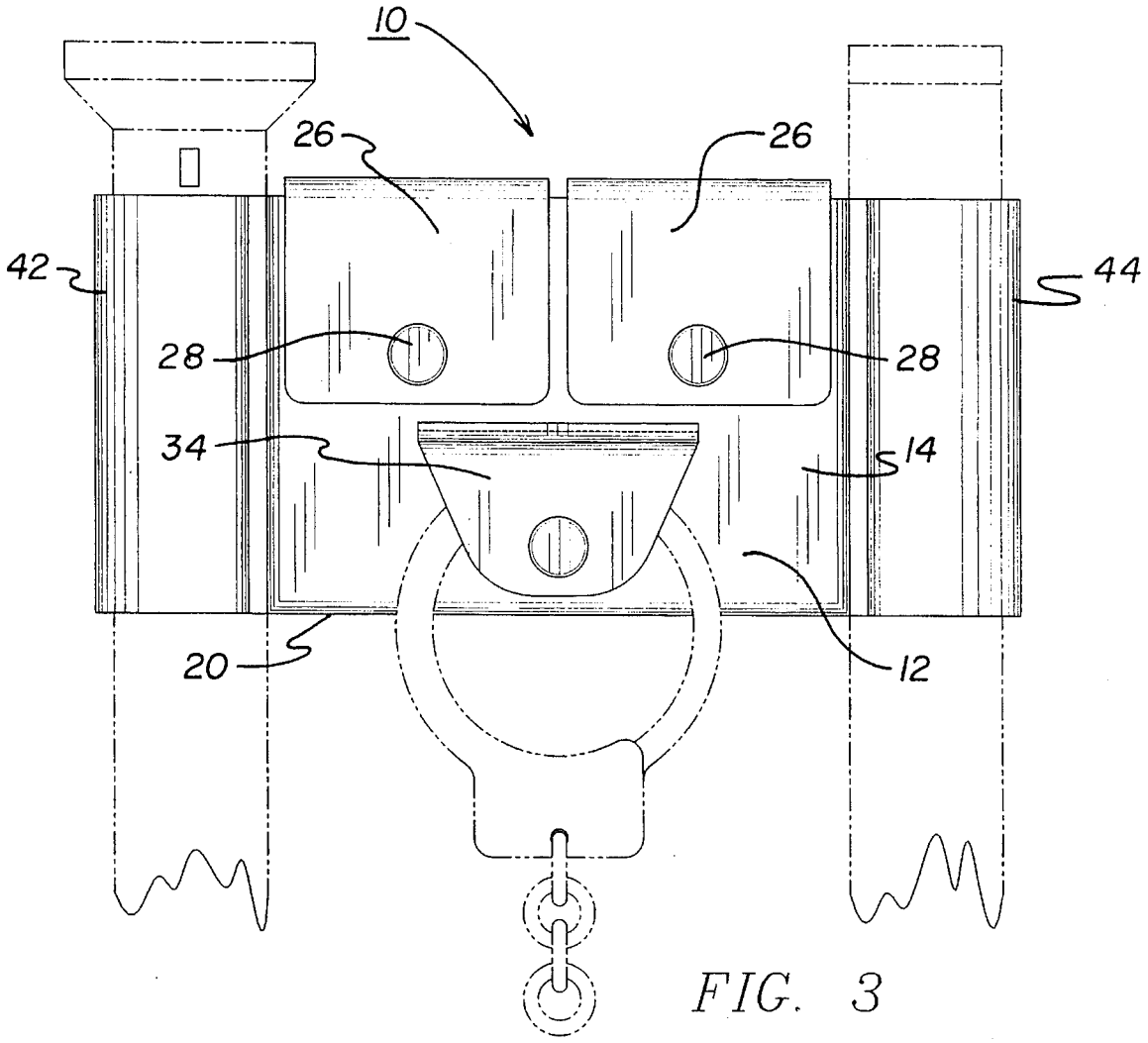
FIG. 3 is a front elevational view of the device shown in FIGS. 1 and 2.
Figure 4:
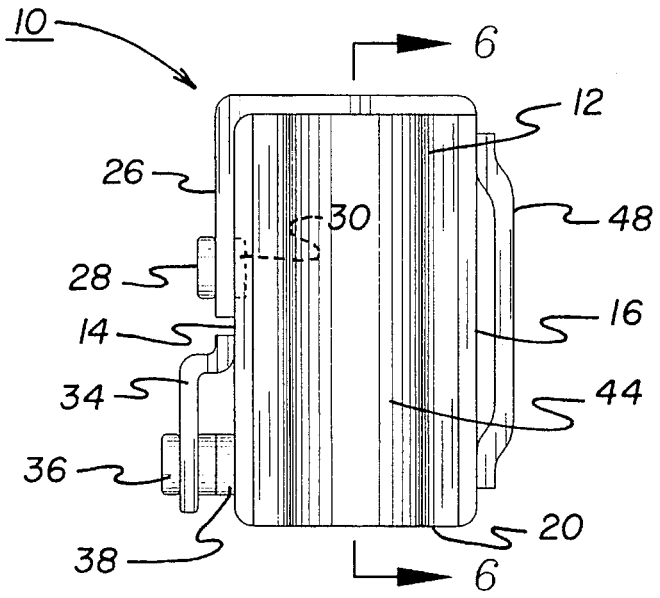
FIG. 4 is a side elevational view of the device shown in the prior Figures.
Figure 5:
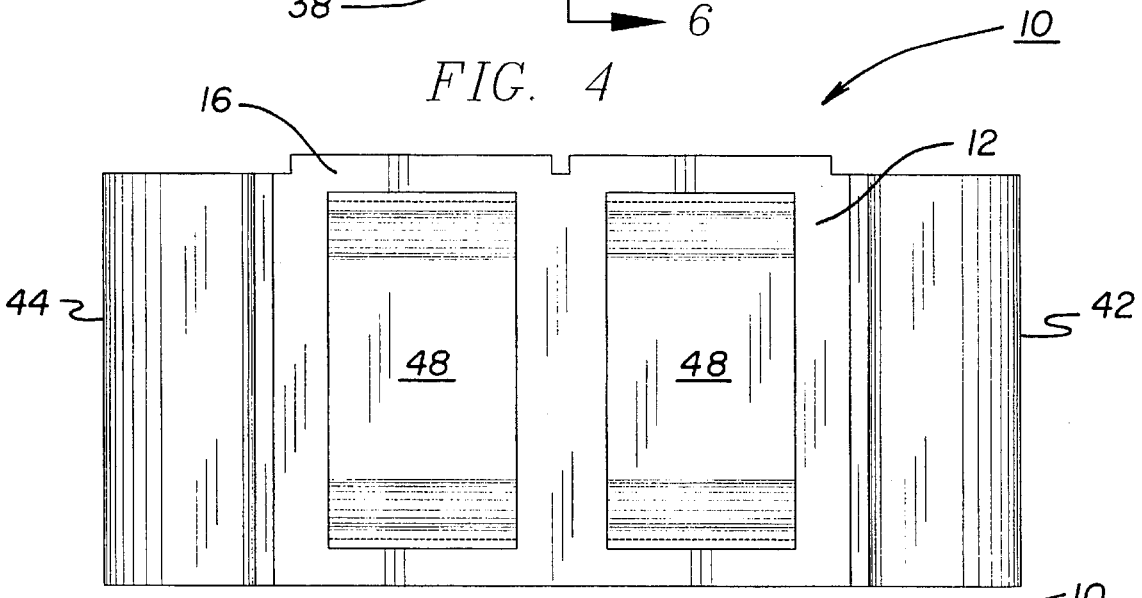
FIG. 5 is a rear elevational view of the device shown in the prior Figures.
Figure 6:
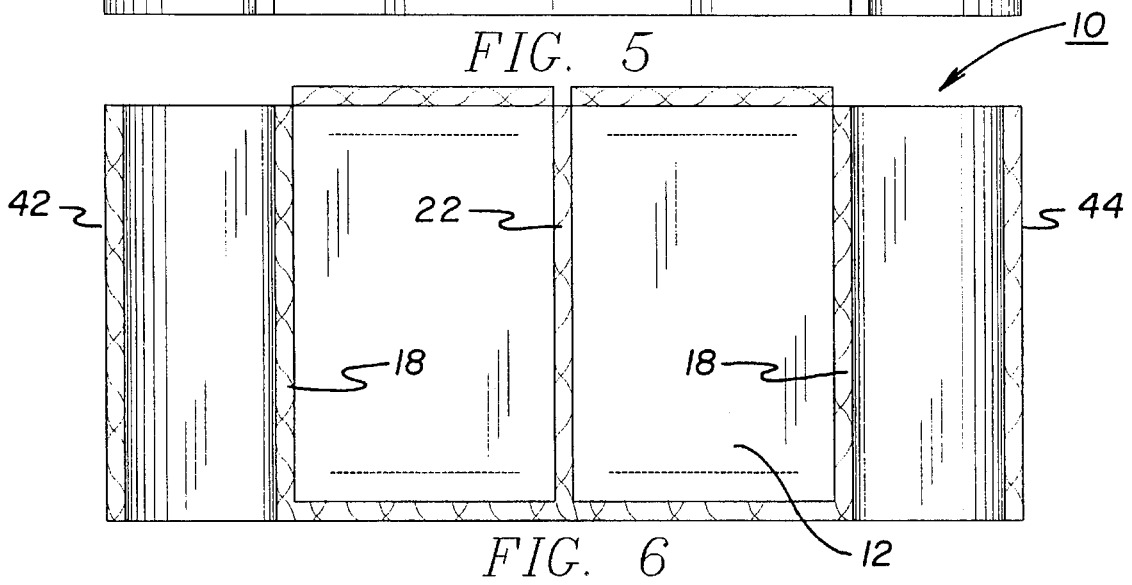
FIG. 6 is a cross-sectional view taken along line 6—6 of FIG. 4.

With reference now to the drawings, and in particular to FIG. 1 thereof, the preferred embodiment of the new and improved device for supporting items for use by a law enforcement officer embodying the principles and concepts of the present invention and generally designated by the reference numeral 10 will be described.

The present invention, the new and improved device for supporting items for use by a law enforcement officer, is a system 10 comprised of a plurality of components. In their broadest context, the components include a central container, a pair of flaps, a supplemental lower flap, rectangular side supports and vertically disposed straps. Each of the individual components is specifically configured and correlated one with respect to the other so as to attain the desired objectives.

The present device is a system 10 for supporting items for use by a law enforcement officer and include as its central component a container 12. Such container is formed of a flexible material in a box-like configuration. Such container has large rectangular parallel front and rear walls 14,16. The container also is formed of small rectangular parallel walls 18 located between the front and rear walls. The container also has rectangular bottom wall 20 with peripheral edges which couple to the lower edges of the front, rear and side walls. The container also has as its last component a vertically disposed divider wall 22 coupling the front, rear and bottom walls located parallel with the side walls. Thus are formed interior of the container two regions for the receipt of ammunition magazines.

In association with the central container 12 are a pair of laterally disposed upper flaps 26. Such flaps are formed as upwardly directed extensions from the upper extent of the rear wall of the container. Such upper flaps are adapted to cover the upper edges of the front, rear and side walls as well as the divider wall. Thus the two regions may be selectively opened and closed providing access or precluding access with respect to the regions within the container, each region being accessible and closable independent of the other. First fasteners 28,30 are also provided. Such fasteners include a fastener 28 on the interior faces of the upper flaps. Such fasteners co-act with first fasteners 30 on the exterior face of the front wall. Such fasteners are for releasably securing the upper flaps in a locked orientation with the access to the interior regions precluded.

Next provided is a supplemental lower flap 34. Such lower flap has an upper edge secured to the exterior surface of the front wall at a location beneath the first fastener 30. The lower flap extends downwardly to a location adjacent to the lower extent of the front wall. At such location there are located co-acting second fasteners 36,38. Such fasteners include a fastener 36 secured to the interior surface of the lower flap adjacent to its lower edge. A co-acting fastener 38 is secured to the exterior surface of the front wall adjacent to its lower extent. The second flap is adapted to form an opening for the receipt and support of handcuffs. The second flap is adapted to be unsnapped for the release of the handcuffs therefrom.

Also provided as part of the container 12 are a pair of rectangular side supports 42,44. Such side supports include a first support 42 formed on one side of the container and a second support 44 formed on the other side of the container. Each of the side supports has an upper and lower edge as well as parallel side edges therebetween. The side edges of each side support is secured to an associated side edge of a side wall. Thus formed on each side of the container is a loop for the receipt and support of a cylindrical object. One support 42 is for supporting a flashlight in one loop and the other side support 44 is for supporting an extensible baton in the other loop.

Lastly provided as part of the container 12 are a pair of vertically disposed straps 48. Such straps are laterally attached to the exterior of the rear face of the container. Such straps are for forming a loop in which is received the belt of a user whereby the container may be supported by the belt of a user.

The present invention is a combination pack for law enforcement officers designed to carry additional ammunition magazines, handcuffs, a flashlight, and an expandable baton.

It could be made from leather, synthetic materials or plastic, and consists of four separate compartments and an exterior holder for handcuffs. Compact and lightweight, it can be easily carried on an officer's pistol belt. A rectangular center section contains two compartments for ammunitions magazines for semiautomatic pistols which are covered with flaps secured with a fastener. Two cylindrical compartments that are open at the top are on either side of the center section. One is for a rechargeable flashlight and the other is for an expandable baton. An exterior flap with a snap fastener is positioned in the front center of the rectangular section to hold a pair of handcuffs. Belt loops are situated on the rear surface of the center section. The pack could be made in different designs to please all users.

Law enforcement officers insert their pistol belts through the present invention's loops and buckle it around their waist. They insert magazines into the two center pockets, the flashlight and baton into the two end pockets, and attach a pair of handcuffs to the pack's front.

The present invention provides a readily accessible holder for an officer's essential equipment in one compact unit, instead of four separate pouches. Also, it is more comfortable and takes up less space on the pistol belt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved device for supporting items for use by a law enforcement officer comprising, in combination:

a central container formed of a flexible material in a box-like configuration, the container having large rectangular parallel front and rear walls with small rectangular parallel side walls therebetween, the front, rear and side walls each having an upper edge, a lower edge, an upper extent, a lower extent, an exterior face and an interior face, the container also having a rectangular bottom wall with peripheral edges coupled to the lower edges of the front, rear and side walls, the container also having a vertically disposed divider wall coupling the front, rear and bottom walls and parallel with the side walls thereby forming two regions for the receipt of ammunition magazines;

a pair of laterally disposed upper flaps each having an exterior face and an interior face, the upper flaps formed as an upward extension from the upper extent of the rear wall and adapted to cover the upper edges of the front, rear and side walls for selectively opening and closing access to the regions of the container, first fasteners on the interior faces of the upper flaps and on the exterior face of the front wall for releasably securing the upper flaps in a locked orientation with the access to the interior regions precluded;

a supplemental flap having an upper edge secured to the exterior face of the front wall at a location beneath the first fasteners, the supplemental flap also having a lower edge, an interior surface and an exterior surface, the supplemental flap extending downwardly to a location adjacent to the lower extent of the front wall, co-acting second fasteners secured to the interior surface of the supplemental flap adjacent to its lower edge and the exterior face of the front wall adjacent to its lower extent, the supplemental flap adapted to form an opening for the receipt and support of handcuffs and also adapted to be unsnapped for the release of the handcuffs therefrom;

a pair of rectangular side supports including a first support and a second support, each of the side supports having upper and lower edges and parallel side edges therebetween with the side edges of each side support secured to an associated side wall to form a loop for the receipt and support of a cylindrical object; and a flashlight removably positioned within the first support;

an extensible baton removably positioned within the second support; and a pair of vertically disposed straps laterally attached to the exterior face of the rear wall for being received and supported by a belt of a user.

* * * * *